US009890569B2

(12) United States Patent
Shah et al.

(10) Patent No.: US 9,890,569 B2
(45) Date of Patent: Feb. 13, 2018

(54) DOOR LATCH ASSEMBLY WITH CONVERTIBLE CAM DRIVE

(71) Applicant: ARCHITECTURAL BUILDERS HARDWARE MFG., INC., Itasca, IL (US)

(72) Inventors: Ankit Kirti Shah, Chicago, IL (US); Kirti Shah, South Barrington, IL (US); Darryl Devine, Huntley, IL (US)

(73) Assignee: ARCHITECTURAL BUILDERS HARDWARE MFG., INC., Itasca, IL (US)

( * ) Notice: Subject to any disclaimer, the term of this patent is extended or adjusted under 35 U.S.C. 154(b) by 360 days.

(21) Appl. No.: 14/695,652

(22) Filed: Apr. 24, 2015

(65) Prior Publication Data

US 2016/0312503 A1 Oct. 27, 2016

(51) Int. Cl.

| | |
|---|---|
| ***E05C 1/06*** | (2006.01) |
| ***E05C 1/14*** | (2006.01) |
| *E05B 55/00* | (2006.01) |

(52) U.S. Cl.

CPC ..... *E05C 1/14* (2013.01); *E05B 55/005* (2013.01)

(58) Field of Classification Search

CPC ... E05C 1/14; E05C 3/162; E05B 7/00; E05B 2001/0076

See application file for complete search history.

(56) References Cited

U.S. PATENT DOCUMENTS

| | | | | |
|---|---|---|---|---|
| 2,108,359 | A | 2/1938 | Accardi | |
| 3,214,947 | A | 11/1965 | Wikkerink | |
| 4,003,593 | A | 1/1977 | Wilzig et al. | |
| 4,007,954 | A | 2/1977 | Erickson | |
| 4,906,034 | A | 3/1990 | Verslycken | |
| 4,986,583 | A | 1/1991 | Campbell et al. | |
| 5,085,474 | A | 2/1992 | Toledo et al. | |
| 5,403,047 | A | 4/1995 | Walls | |
| 5,730,478 | A | 3/1998 | D'Hooge | |
| 6,196,599 | B1 | 3/2001 | D'Hooge | |
| 6,293,598 | B1 * | 9/2001 | Rusiana | E05B 7/00 292/143 |
| 7,258,374 | B2 | 8/2007 | Rusiana | |
| 7,481,607 | B2 | 1/2009 | Rusiana et al. | |
| 2004/0227351 | A1 | 11/2004 | Lin | |
| 2006/0261608 | A1 * | 11/2006 | Rusiana | E05C 1/14 292/336.3 |

* cited by examiner

*Primary Examiner* — Mark Williams

(74) *Attorney, Agent, or Firm* — Greer, Burns & Crain, Ltd.

(57) ABSTRACT

A door latch assembly is described with a convertible cam drive having a door bolt assembly including a sliding bolt configured for reciprocal sliding action between a latch position and a release position. Such an embodiment includes a cam drive assembly having a bolt actuator as well as a cam holder configured for placement within the cam receiving aperture of the base plate to accommodate the base plate being mounted in one of the plurality of orientations with respect to the door. The cam drive assembly is constructed and arranged for receiving the cam engaging portion of the door handle when pivoted from the rest position to the actuating position, thereby causing the sliding bolt to move from a latch position to a release position using the bolt actuator.

12 Claims, 16 Drawing Sheets

DOOR LATCH ASSEMBLY WITH CONVERTIBLE CAM DRIVE

BACKGROUND

The present invention relates generally to door latch assemblies that include a door bolt assembly operable by a door handle assembly preferably having a paddle style handle. More specifically, the present disclosure relates to a door latch assembly configured to operate with selectively positionable door handles in either in up, down, horizontal left or horizontal right configurations.

Examples of existing door latch, door bolt, and door handle assemblies are described in U.S. Pat. Nos. 6,293,598; 7,258,374; 7,481,607; 6,196,599 and U.S. Pat. No. 5,730,478, and US Patent Publication No. 2013/0076046A1, all commonly assigned to Architectural Builders Hardware Manufacturing, Inc., as well as U.S. Pat. Nos. 4,986,583 and 5,403,047 all of which are hereby incorporated by reference. Such door latch assemblies include, generally, a door bolt assembly with a latch mechanism, and at least one door handle mechanism.

In some cases, institutions such as hospitals occasionally update their door latch configurations. This process involves providing new handles while retaining the existing latch/bolt assembly. In many cases, the new handles are mechanically incompatible with the existing latch/bolt, requiring that the latch/bolt be replaced as well. Such replacement adds additional material and labor costs to the institution.

A common problem of conventional door latch and door handle assemblies is that they can only be positioned in one orientation, up, down, horizontal left or horizontal right configurations due to the size of the hole of the door through which they are mounted. However, in some instances, the orientation of the door handle may need to be changed from up or down to horizontal left or horizontal right without resizing the hole in the door. For example, an installer may make a mistake in sizing of a hole through the door to install a door latch assembly such that the door handles cannot be oriented in a vertical position (parallel to the length of the door). However, by orienting the door handles in a horizontal position (perpendicular to the length of the door), an installer may still be able to use the hole in the door without resizing it. In another example, a horizontal orientation of a door handle may be preferred by a door latch assembly user because of the circumstances in which the room with the door is used. For instance, the door may be an entrance to a hospital room or assisted living room such that the patient in the room is more comfortable in gripping a paddle style door handle when oriented horizontally rather than vertically.

Conventional door latch and door handle assemblies do not allow for such a change in orientation in an easy straightforward manner using the same door latch/handle assemblies. In addition, there is a need for a latch/bolt mechanism which facilitates exchange of handle types without requiring latch/bolt replacement.

SUMMARY

The above-listed needs are addressed by the present door latch assembly, which features a convertible cam drive assembly that allows the same door latch/handle assemblies to be used when orienting the door handle into different configurations (e.g. up, down, horizontal left or horizontal right). Another feature of the present cam drive assembly is that it accommodates a variety of handle operational mechanisms.

More specifically, an embodiment of a door latch assembly is described with a convertible cam drive having a door bolt assembly including a sliding bolt configured for reciprocal sliding action between a latch position and a release position. Such an embodiment includes a door handle assembly having a base plate, a pivot pin and a cam receiving aperture of the base plate, and configured for being fastened to a door in one of a plurality of orientations with respect to a length of the door. Further, the present door handle assembly includes a door handle configured for pivoting relative to the pivot pin from a rest position to an actuating position and having a cam engaging portion. A cam drive assembly has a bolt actuator as well as a cam holder configured for placement within the cam receiving aperture of the base plate for accommodating the base plate being mounted in one of the plurality of orientations with respect to the door. The cam drive assembly is constructed and arranged for receiving the cam engaging portion of the door handle when pivoted from the rest position to the actuating position, thereby causing the sliding bolt to move from a latch position to a release position using the bolt actuator.

In another embodiment, door handle assembly is provided for use with a door latch assembly with a cam assembly further having a separate cam actuator configured for attachment to the cam engaging portion of the door handle and engaging a bolt actuator such that cam actuator is mountable upon the door handle in a selected one of a plurality of orientations. Such a door latch assembly includes a door bolt assembly having a sliding bolt configured for reciprocal sliding action between a latch position and a release position, and having a bolt opening and a rear surface. Further, the door latch assembly includes a door handle assembly having a pivot pin as well as a door handle configured for pivoting relative to the pivot pin from a rest position to an actuating position and having a cam engaging portion. In addition, the door handle assembly includes a base plate coupled to the door handle, having a cam receiving aperture, and configured for attaching to a door in one of a plurality of orientations with respect to the length of the door. Moreover, the door latch assembly includes a cam drive assembly having a cam with a finger as well as a cam holder configured for placement within the cam receiving aperture of the base plate in one of a plurality of orientations with respect to the door. The cam actuator is secured to the cam engaging portion of the door handle and configured for moving the finger laterally along the axis of the sliding bolt within the bolt opening and making contact with the rear surface of the sliding bolt thereby moving the sliding bolt from the latch position to the release position.

DETAILED DESCRIPTION

Figure 1:
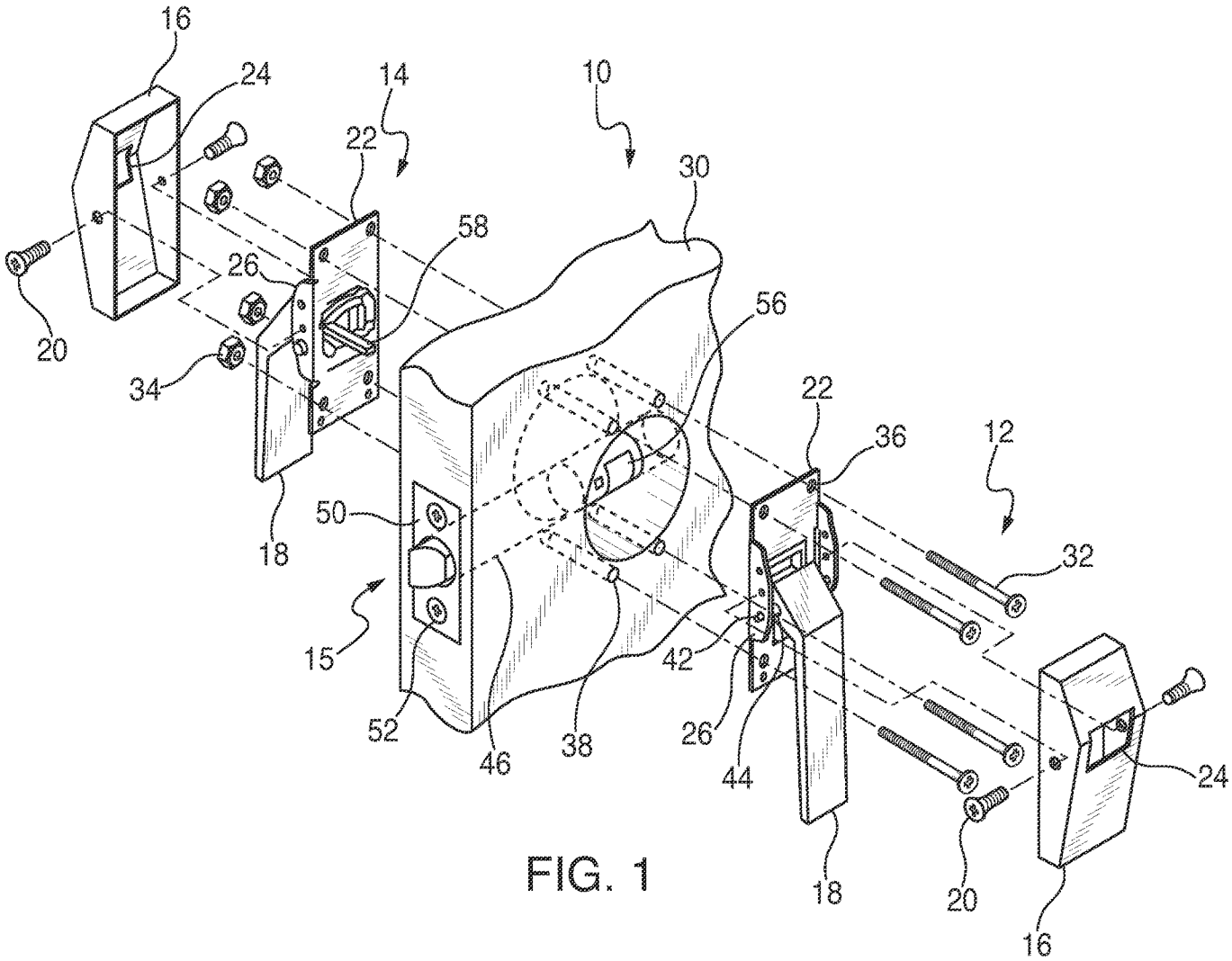
FIG. 1 is top exploded perspective view of the present door latch assembly shown mounted on a door.

Referring now to FIG. 1, the present door latch assembly is shown and generally designated 10. The door latch assembly 10 includes door handle assemblies 12 and 14 as well as a door bolt assembly 15. Each door handle assembly 12, 14 is similar except one is optionally configured as a push door handle assembly and another is optionally configured as a complimentary pull door handle assembly. As such, only one will be described in detail. Included in the door handle assembly 12, 14 is a faceplate or cover plate 16, a door handle 18, and at least one faceplate fastener 20 such as a screw used for securing the faceplate to a mounting plate or base plate 22. Further, each faceplate 16 has a faceplate opening 24 that is configured for allowing the door handle 18 to pass through for actuation by a user. FIG. 1 shows each faceplate opening 24 being rectangular in shape, however, persons of ordinary skill in the art would understand that other shapes are contemplated.

In addition, each faceplate 16 is secured to sidewalls 26 of the mounting/base plate 22 using the faceplate fasteners 20. Moreover, each door handle 18 is configured to be pivotably secured to a corresponding mounting/base plate 22. Further, each door handle 18 is configured for movement between a rest position and an actuating position to open the door by actuating (lifting or pressing) the door handle about a pivot point described below.

The door handle assemblies 12, 14 are secured to a door 30 by a plurality of mounting fasteners 32, such as bolts and associated mounting nuts 34. Further, each mounting/base plate 22 has a plurality of mounting openings 36 configured for being in registry with associated mounting openings 38 on the door 30. The mounting bolts 32 are passed through the mounting plate openings 36 then through the door mounting openings 38 and the mounting openings of the other mounting/base plate 22. As is known in the art, the mounting bolts 32 are then secured using the mounting nuts 34.

A pivot pin 42 is configured to pass through a selected pair of corresponding aligned openings in the sidewalls 26. The pivot pin 42 also passes through a complementary bore 44 (FIG. 6) in the door handle 18 and maintains pivoting action and alignment of the door handle 18 relative to the mounting plate 22. A torsion spring (not shown) is located on the pivot pin 42 and is configured for returning the door handle 18 to the rest position when released. As is known in the art, the torsion spring is preferably U-shaped with coiled spring-shaped side portions, a horizontal bottom portions and a pair of legs. Each of the spring-shaped side portions is configured for wrapping around the pivot pin 42, on opposite sides of the door handle 18.

While other configurations are contemplated, the door latch assembly 10 is preferably a so-called "low profile" design as is well known in the art. Included in the assembly 10 is the door bolt assembly 15 including a sliding bolt 46 made up of an outside barrel 47 and an inside barrel 48 reciprocating within the outside barrel between a latched and a released or retracted position. Also included on the outside barrel is a dress plate 50 at one end of the sliding bolt 46. At least one dress plate fastener 52 passes through the dress plate 50 and an underlying back plate for attaching the door bolt assembly 15 to the door 30. If desired, spacers are located between the back plate and the dress plate 50.

Figure 2:
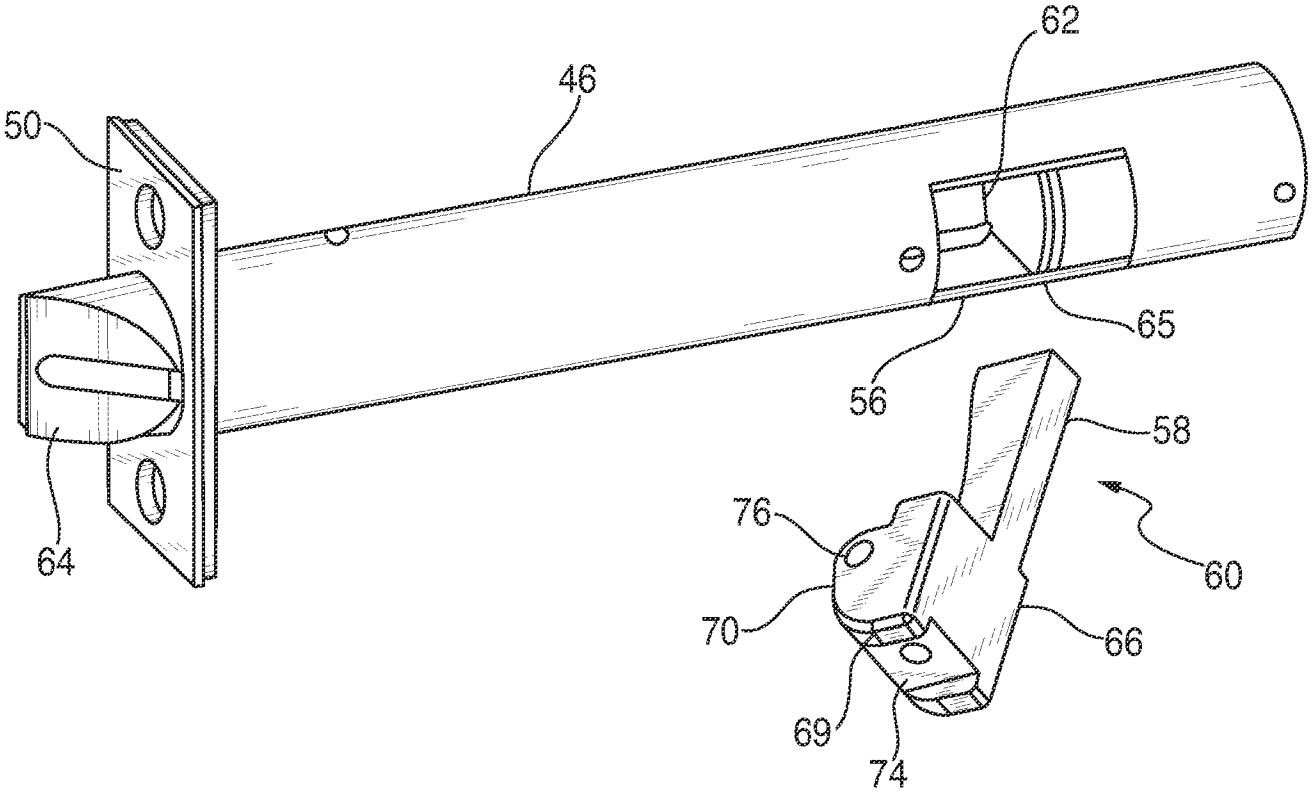
FIG. 2 is a side perspective view of a cam with finger used in conjunction with a sliding bolt in the present door latch assembly.

Referring now to FIG. 2, included within the sliding bolt 46 is a sliding bolt opening 56 in the outside barrel 47 configured for receiving a finger 58 of the door handle assembly 12, 14. The finger 58 is attached to a pivoting cam 60. While in the preferred embodiment, the finger 58 and the cam 60 are integrally formed, as by casting, other fabrication techniques, including separate finger and cam attached during assembly, are contemplated. On the inside barrel 48, a corresponding inside barrel opening 62 is in registry with the sliding bolt opening 56 when the door bolt assembly 15 is in the latched or rest position. A spring (not shown) contained within the rear of the sliding bolt 46, biases the rear surface 65 of the sliding bolt 65 to maintain the sliding bolt in a latched position. The finger 58 makes contact with a rear surface 65 of the sliding bolt 46, causing the inside barrel 48 to laterally slide relative to the outside barrel 47, overcoming the default biased force of the spring and opening the latch to a released or retracted position by retracting a strike 64 relative to the dress plate 50.

Figure 4:
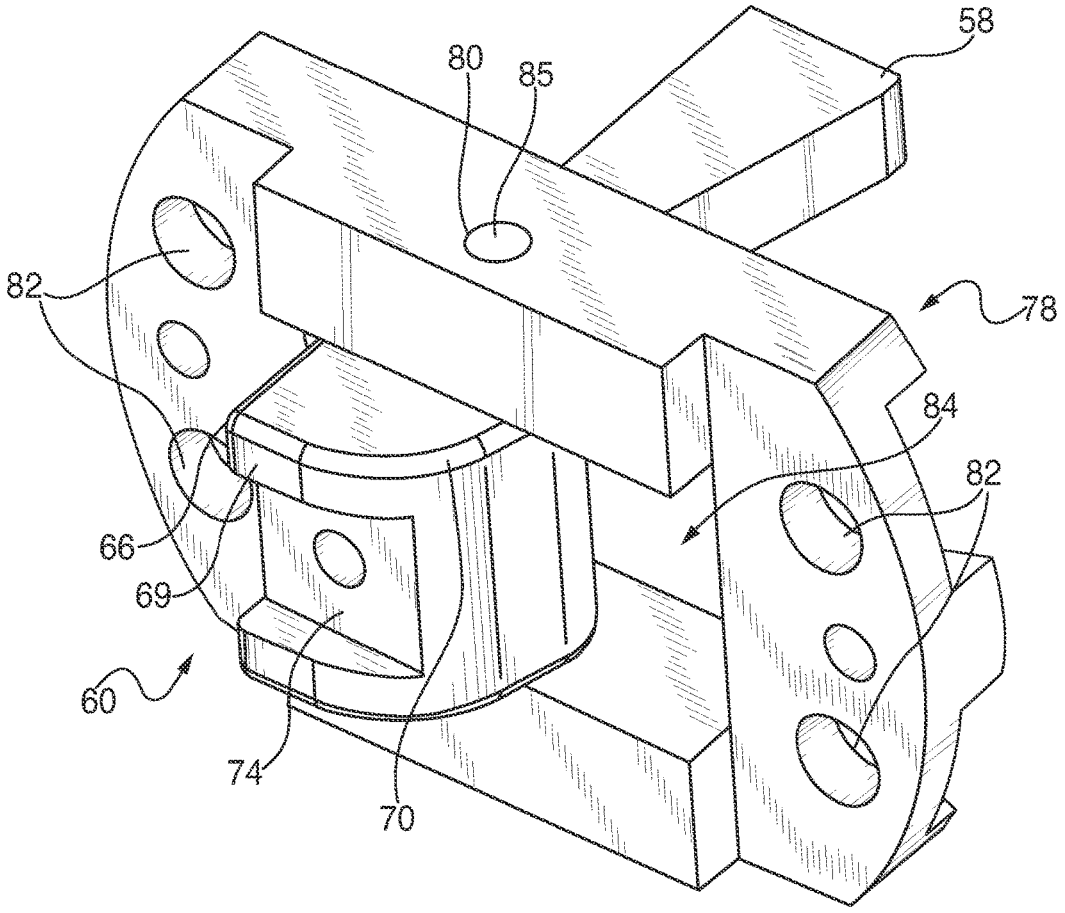
FIG. 4 is a side perspective view of the cam in the cam holder used in the present door latch assembly.

Further, the cam 60 includes a cam body 66 configured for engaging a cam actuator 67, 68 (FIGS. 7, 8) secured to the door handle 18. The cam body 66 includes a plurality of surfaces such as a cam body rear surface 69 and a cam body curved surface 70 which are configured with certain angles, radii, and finishes to engage the cam actuator 67, 68 secured to the door handle 18 and operate the door latch when the door handle 18 is selectively oriented horizontally (perpendicular to the length of the door 30, or vertically, parallel to the length of the door). In addition, the cam 60 includes pivot pin hole 76 configured for receiving a cam pivot pin 85 (FIG. 4). When the cam actuator 67, 68 engages the cam body 66, the cam 60 is rotated about the pivot pin 85 thereby engaging the finger 58 with the rear surface 65 of sliding bolt 46 of the door bolt assembly 15 and overcoming the default biased condition of the sliding bolt to move it from a latch position to a release position.

Figure 3:
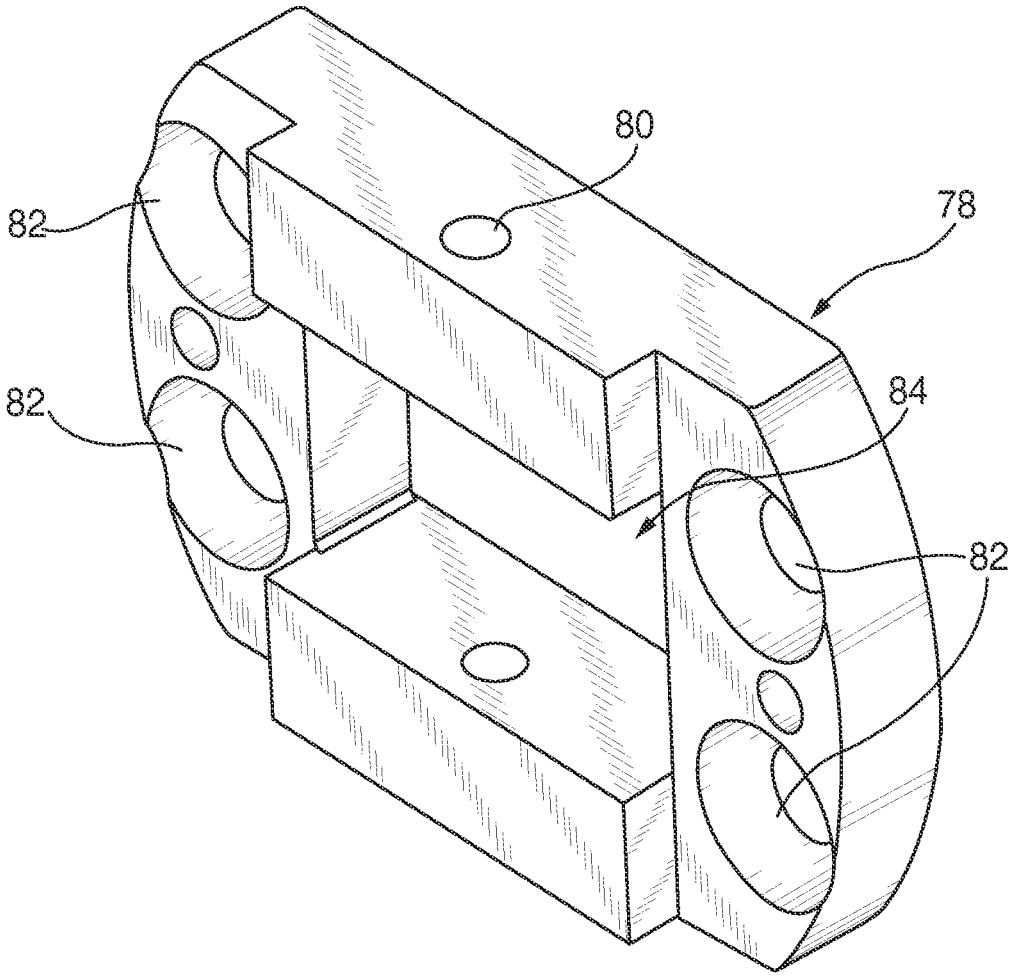
FIG. 3 is a side perspective view of a cam holder used in the present door latch assembly.
Figure 5:
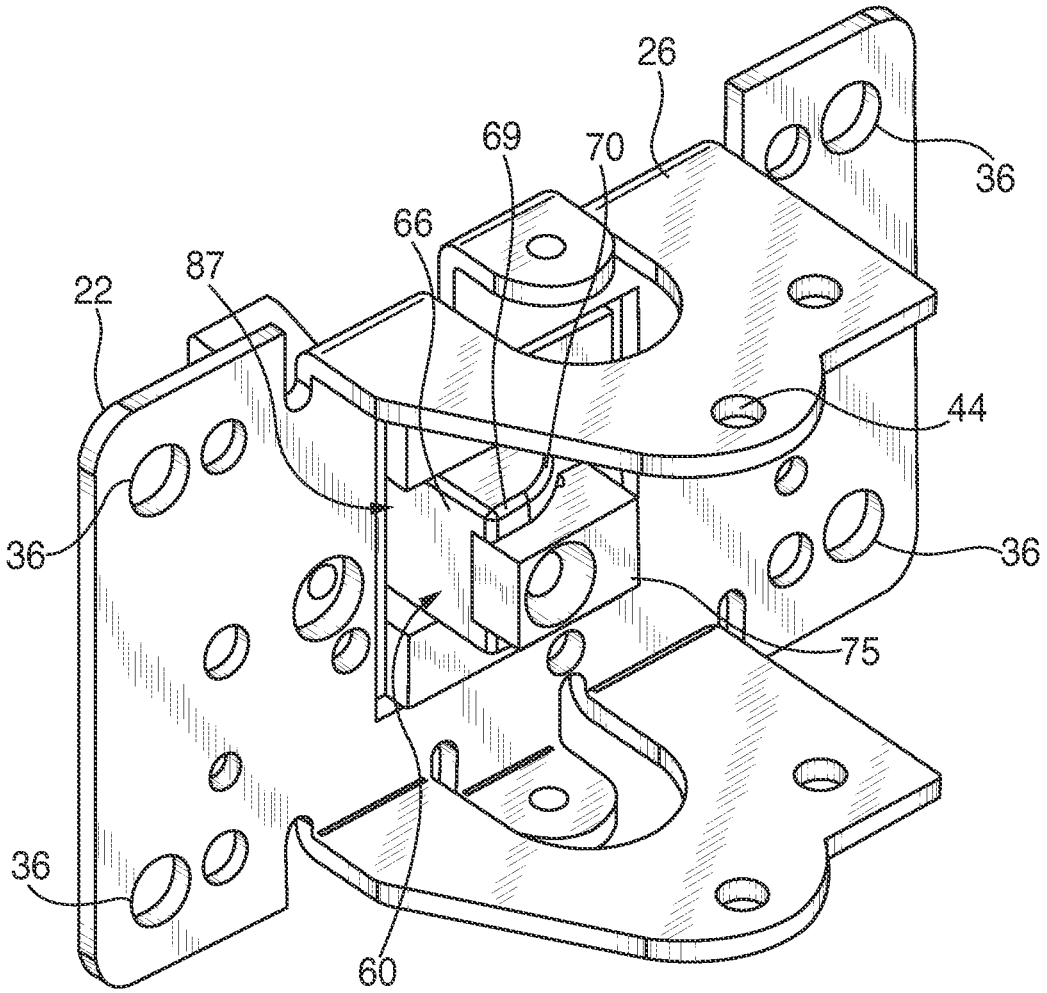
FIG. 5 is a side perspective view of the cam and cam holder fastened to the base plate used in the present door latch assembly.

Referring now to FIGS. 3-5, the cam holder 78 includes a cam receiving aperture 84. Preferably, the aperture 84 is dimensioned for accommodating significant lateral sliding action of the finger 58 as the cam 60 pivots in the aperture. Further, the cam holder 78 includes a cam pivot pin bore 80 configured for receiving the cam pivot pin 85. The cam receiving aperture 84 receives the cam body 66, and the cam pivot pin 85 of the cam holder 78 holds the cam in place, allowing the cam 60 to pivot around the pivot pin. In addition, the cam holder 78 is mounted on the base plate 22 by cam mounting fasteners through a plurality of mounting holes 82 on the cam holder. The assembled cam holder 78 with the cam 60 (having cam body 66 and surfaces 69, 70) is mounted on the base plate 22 such that the door handle 18 is selectively oriented in one of a horizontal (perpendicular to the length of the door) and vertical position relative to the door 30. Further, the embodiment of the cam 60 includes a cam body notch 74 configured for accommodating a cam block 75 (FIG. 5).

Referring now to FIG. 5, a cam block 75 is optionally secured to the cam 60. Such a cam block may be engaged by an embodiment of a cam actuator 67, 68 secured to a door handle. As mentioned herein, the cam 60 includes a cam body 66 with cam body rear surface 69 and cam body curved surface 70 to be used with other embodiments of a cam actuator 67, 68. In addition, the cam holder 78 with the cam 60 are mounted to the base plate 22 to be positioned within the cam receiving aperture 87 of the base plate. The mounting plate openings 36 are used to mount the base plate 22 to the door 30. Further, the pivot bore handle sliding bolt 44 is used to attach the door handle 18 to the base plate 22.

Figure 6:
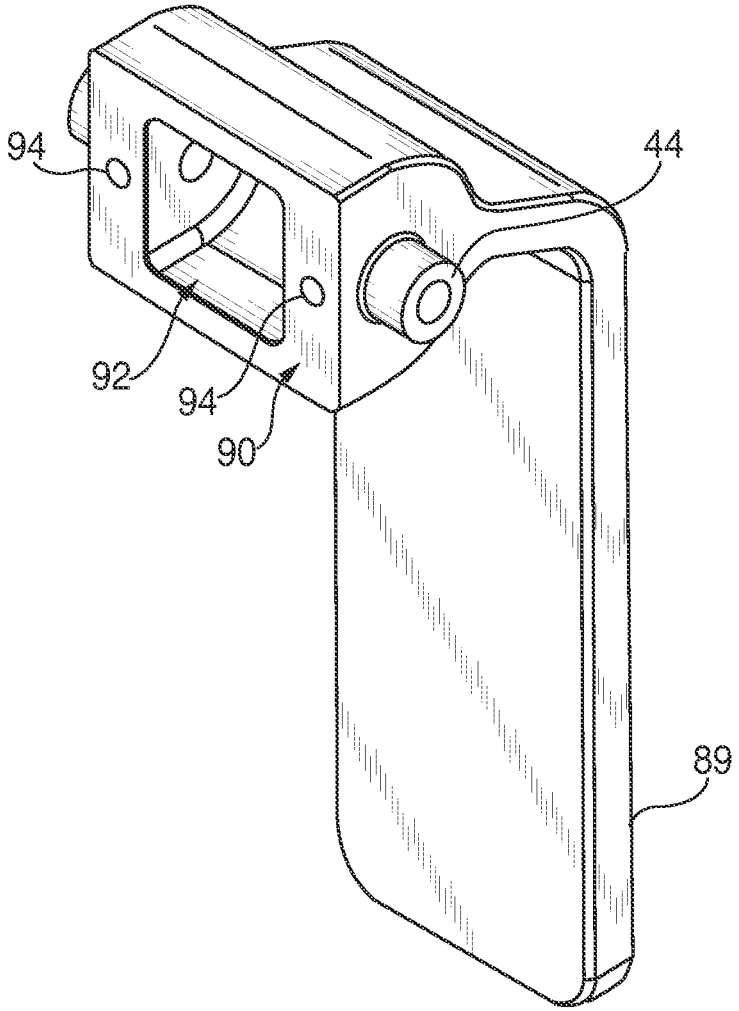
FIG. 6 is a side perspective view of a universal handle used in the present door latch assembly.

Referring now to FIG. 6, an embodiment of a universal door handle 89 is shown and is configured to be mounted onto base plate 22 as shown in FIG. 5 such that the orientation of the door handle is horizontal (perpendicular to the length of the door) or vertical (parallel to the length of the door). The universal door handle 89 includes and cam engaging portion 90 of the door handle used to engage a cam actuator 67, 68 and a door handle aperture 92 for accommodating the cam actuator. In addition, the universal door handle 89 includes a plurality of mounting holes 94 to secure the cam actuator 67, 68 to the universal door handle.

Figure 7:
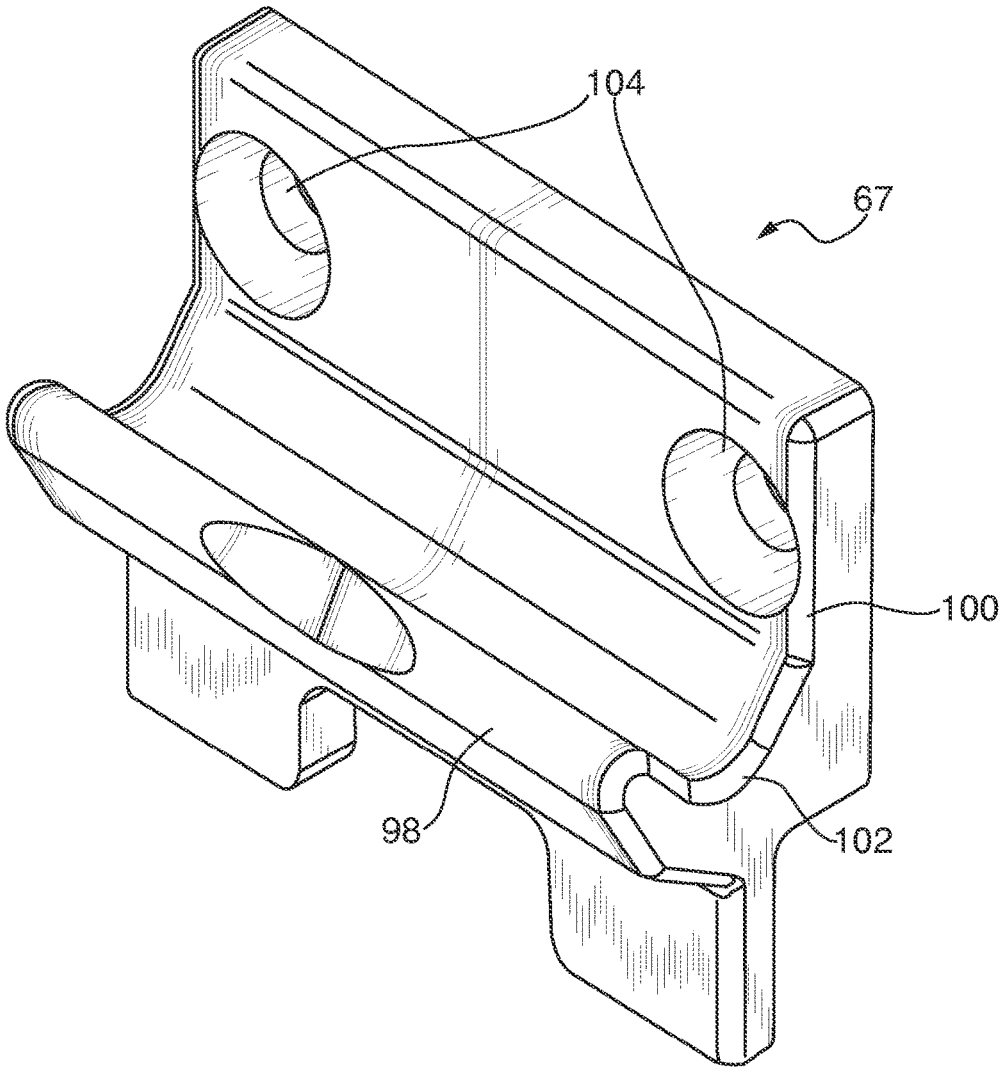
FIG. 7 is a side perspective view of an embodiment of a push/pull cam actuator (mortise backset) used in the present door latch assembly.

Referring now to FIG. 7, an embodiment of the cam actuator 67 is configured to be attached or coupled to a cam engaging portion 90 of the door handle 89. The embodiment of the cam actuator 67 may be called a cam actuator with a mortise backset. Such a cam engaging portion 90 is one or more front surfaces of the door handle 89. Further, the cam actuator 67 is configured to engage the cam 60 thereby overcoming the default biased force of the spring of the sliding bolt mechanism of the door bolt assembly 15 from a latched position to a release position. The cam actuator 67 includes a lip 98, a flat cam engaging surface 100, and a curved cam engaging surface 102. Further, the flat cam engaging surface 100 and the curved cam engaging surface 102 are configured in certain angles, radii, and finishes to engage the cam 60 and cam body 66 having complimentary surfaces 69, 70 configured in certain angles, radii, and finishes. The cam actuator 67 may be paired with a push or pull door handle 18 and then oriented either horizontally (perpendicular to the length of the door) or vertically (parallel to the length of the door) depending on need. Further, the cam actuator 67 includes a plurality of cam actuator mounting holes 104 that are used to mount the cam actuator to the universal door handle 89.

Figure 8:
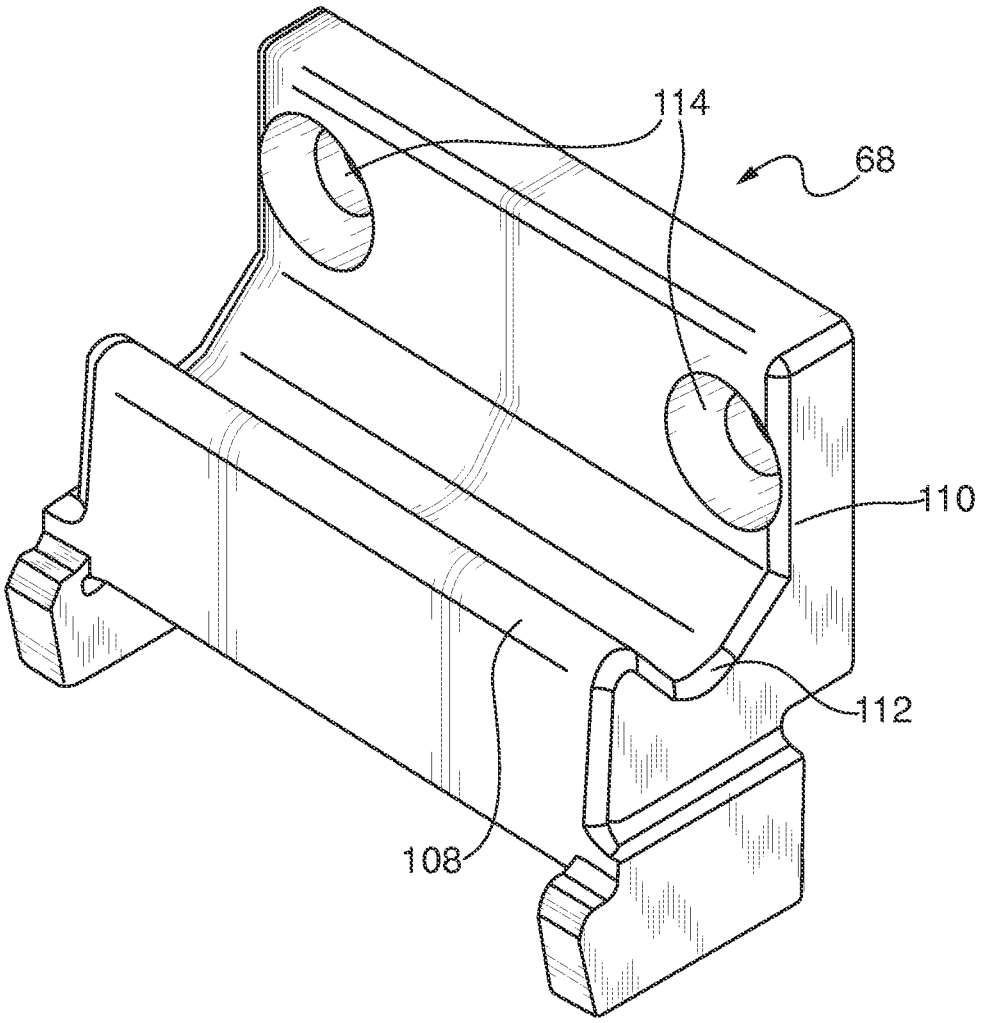
FIG. 8 is a side perspective view of an embodiment of a push/pull cam actuator (low profile backset) used in the present door latch assembly.

Referring now to FIG. 8, an alternate embodiment of the door handle cam actuator is generally designated 68. The cam actuator 68 is particularly configured for use with the push/pull low profile door latch assemblies and is configured to be attached or coupled to a cam engaging portion of the door handle 89. Such a cam engaging portion is one or more front surfaces 90 of the door handle 89. Further, the door handle cam actuator 68 is configured to engage the cam 60 thereby, overcoming the default biased force of the spring of the sliding bolt mechanism of the door bolt assembly 15 from a latched position to a release position. The cam actuator 68 includes a lip 108, a flat cam engaging surface 110, and a curved cam engaging surface 112. Further, the flat cam engaging surface 110 and the curved cam engaging surface 112 are configured in certain angles, radii, and finishes to engage the cam 60 and cam body 66 having complimentary surfaces 69, 70 configured in certain angles, radii, and finishes. The cam actuator 68 may be paired with a push or pull door handle 18 and then oriented either horizontally (perpendicular to the length of the door) or vertically (parallel to the length of the door) depending on need. Further, the cam actuator 68 includes a plurality of cam actuator mounting holes 114 that are used to mount the cam actuator to the universal door handle 89.

Figure 9:
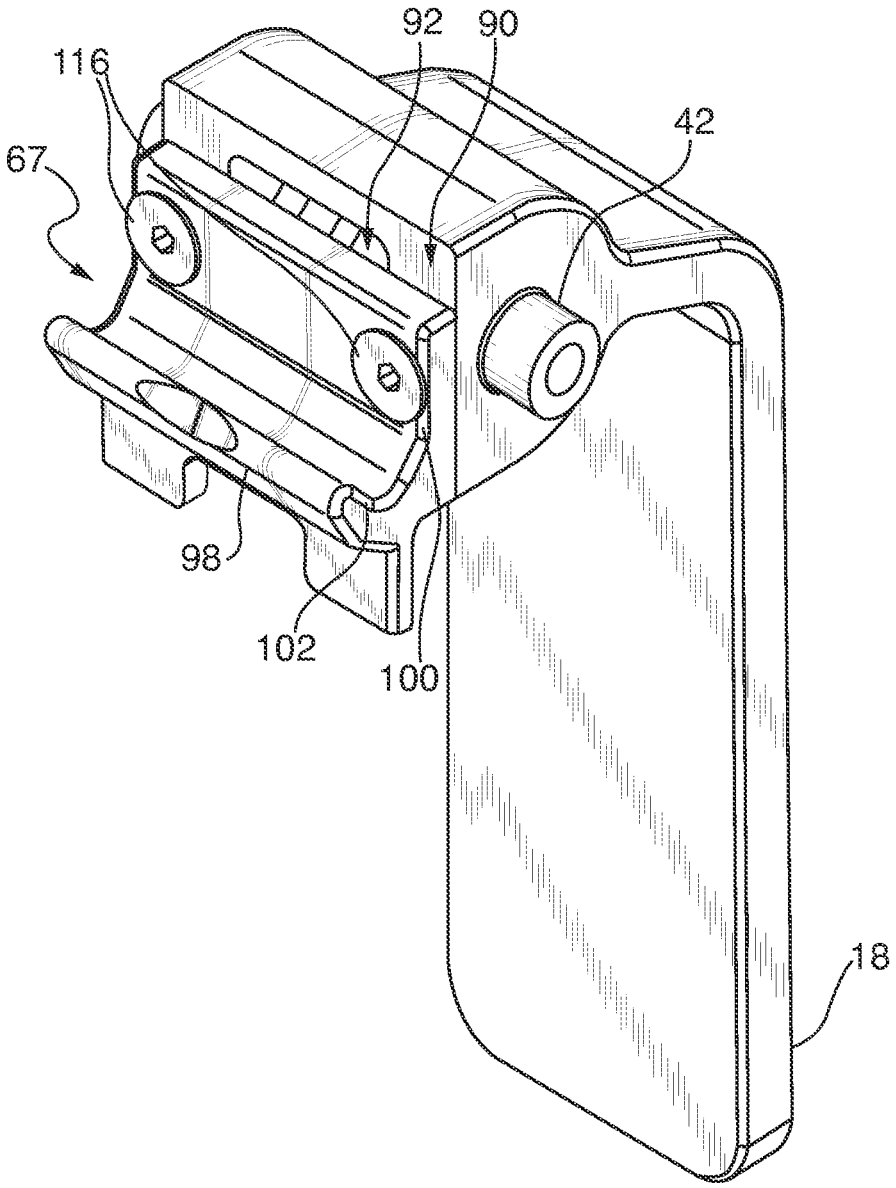
FIG. 9 is a side perspective view of an embodiment of a push door handle assembly with a cam actuator (mortise backset) used in the present door latch assembly.
Figure 10:
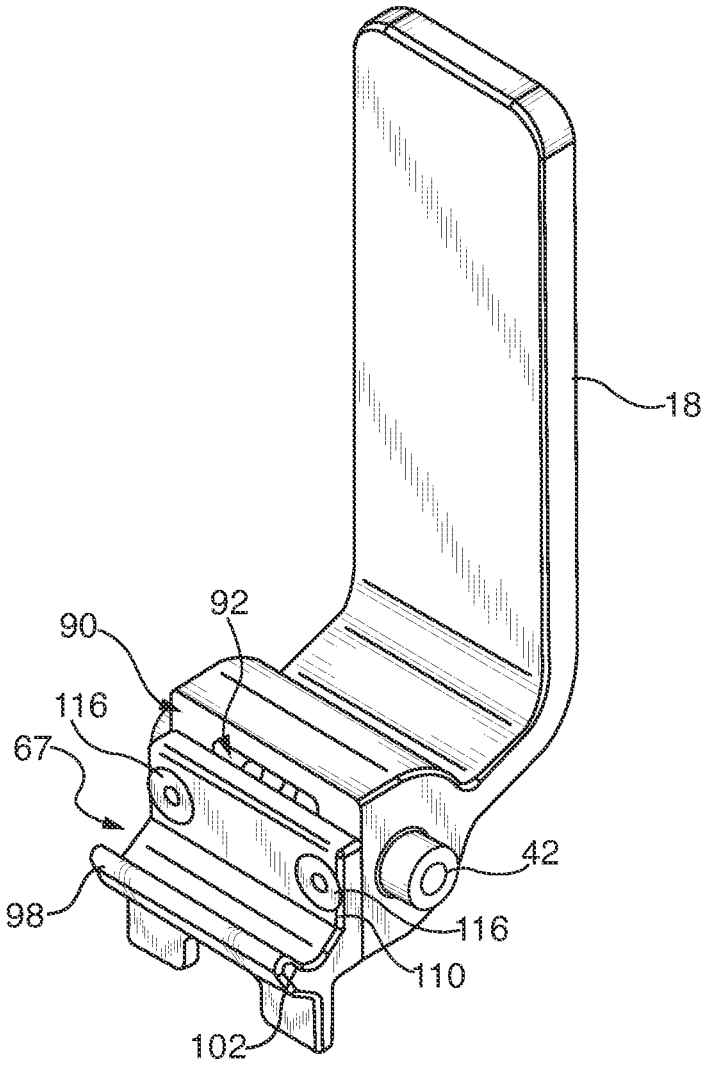
FIG. 10 is a side perspective view of an embodiment of a pull door handle assembly with a cam actuator (mortise backset) used in the present door latch assembly.

Referring now to FIGS. 9-10, an embodiment of a cam actuator 67 is attached, fastened, or otherwise coupled to the cam engaging portion 90 of an embodiment of a push/pull door handle 89 (e.g. front surface(s) of the door handle 89). Further, an embodiment of a push/pull door handle 89 is configured to be actuated relative to a pivot pin 42 between a rest (latched) position and an actuated (release) position. In the rest position, the cam actuator 67 touches the cam 60, but does not engage the cam 60 to move the sliding bolt mechanism of the door bolt assembly 15 thereby remaining in a latch position. In the actuated position, the cam actuator 67 does engage the cam 60 with its lip 98 and surfaces 100, 102 to move the sliding bolt mechanism of the door bolt assembly 15, thereby positioning the sliding bolt mechanism in the release position. The cam actuator 67 is secured to the universal door handle 89 using a plurality of cam actuator mounting fasteners 116 against the cam engaging portion 90 and door handle aperture 92 for accommodating the cam actuator. FIG. 9 shows the cam actuator 67 with mortise backset secured to a push door handle 89. FIG. 10 shows the cam actuator 67 with mortise backset secured to a pull door handle.

Figure 11:
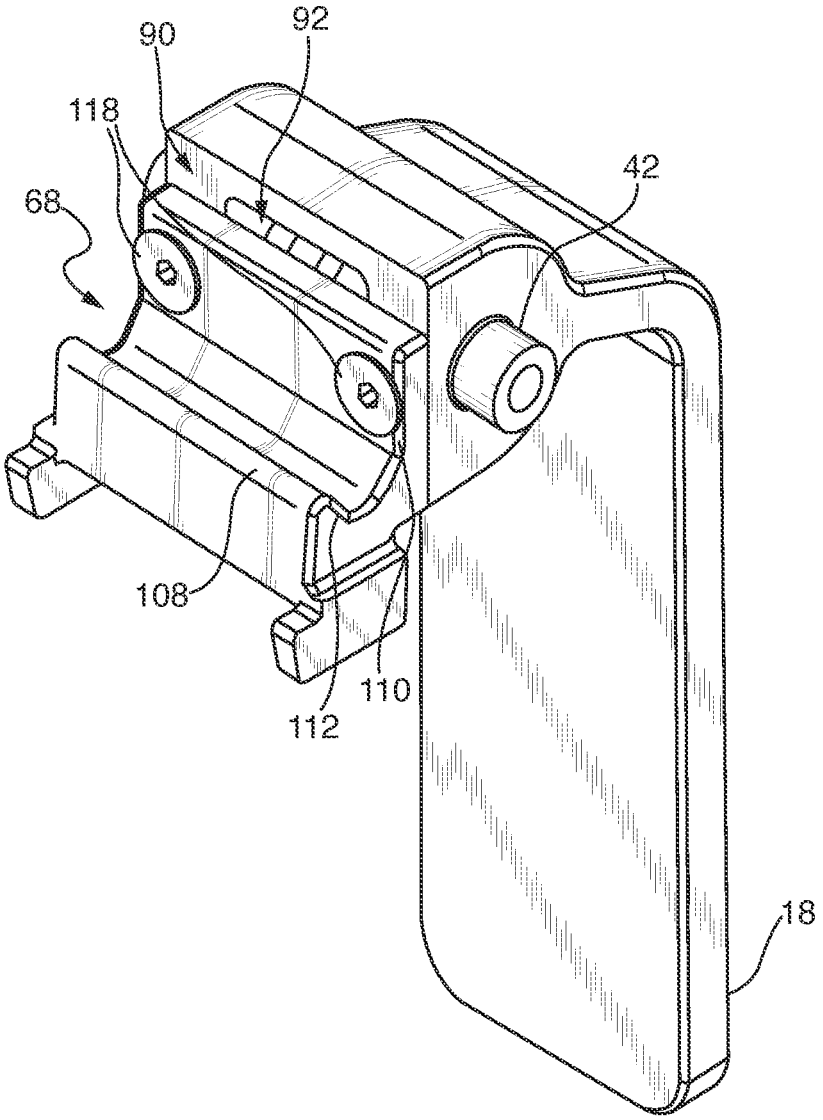
FIG. 11 is a side perspective view of an embodiment of a push door handle assembly with a cam actuator (low profile backset) used in the present door latch assembly.
Figure 12:
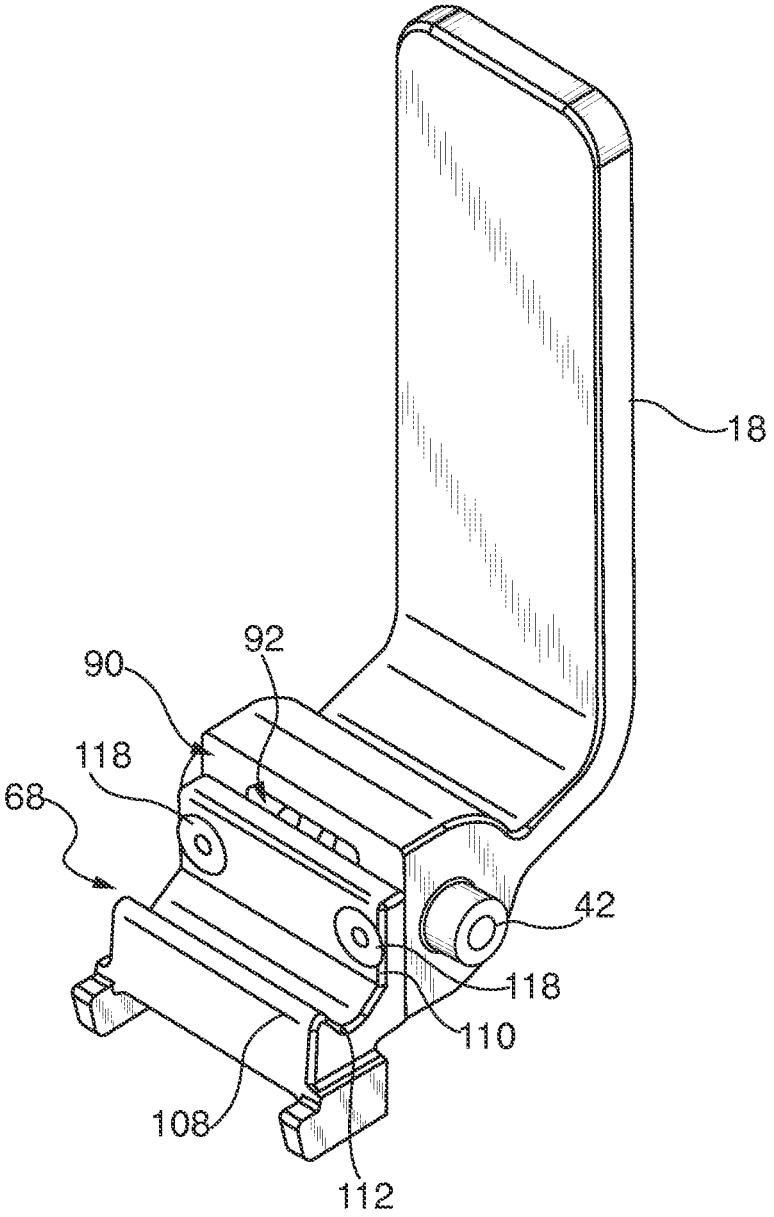
FIG. 12 is a side perspective view of an embodiment of a pull door handle assembly with a cam actuator (low profile backset) used in the present door latch assembly.

Referring now to FIGS. 11-12, an embodiment of the cam actuator 68 is attached, fastened, or otherwise coupled to the cam engaging portion 90 of the push/pull door handle 89 (e.g. front surface(s) of the door handle 89). Further, an embodiment of a push/pull door handle 89 is configured to be actuated relative to a pivot pin 42 between a rest position and an actuated position. In the rest position, the cam actuator 68 does not engage the cam 60 to move the sliding bolt mechanism of the door bolt assembly 15 thereby remaining in a latch position. In the actuated position, the cam actuator 68 engages the cam 60 with its lip 108 and surfaces 110, 112 to move the sliding bolt mechanism of the door bolt assembly 15 thereby positioning the sliding bolt mechanism in the release position. The cam actuator 68 is secured to the universal door handle 89 using a plurality of cam actuator mounting fasteners 118 against the cam engaging portion 90 and the door handle aperture 92 for accommodating the cam actuator. FIG. 11 shows the cam actuator 68 with low profile backset secured to a push door handle 89. FIG. 10 shows the cam actuator 68 with profile backset secured to a pull door handle.

Embodiments of the present door latch assembly 10 include cam actuators 67, 68 coupled to either a push or pull door handle 18 that engages a cam 60 having a cam block 75 attached to the cam body notch 74. Other embodiments include cam actuators 67, 68 coupled to either a push or pull door handle 18 that engages a cam 60 without cam block 75 attached.

Figure 13:
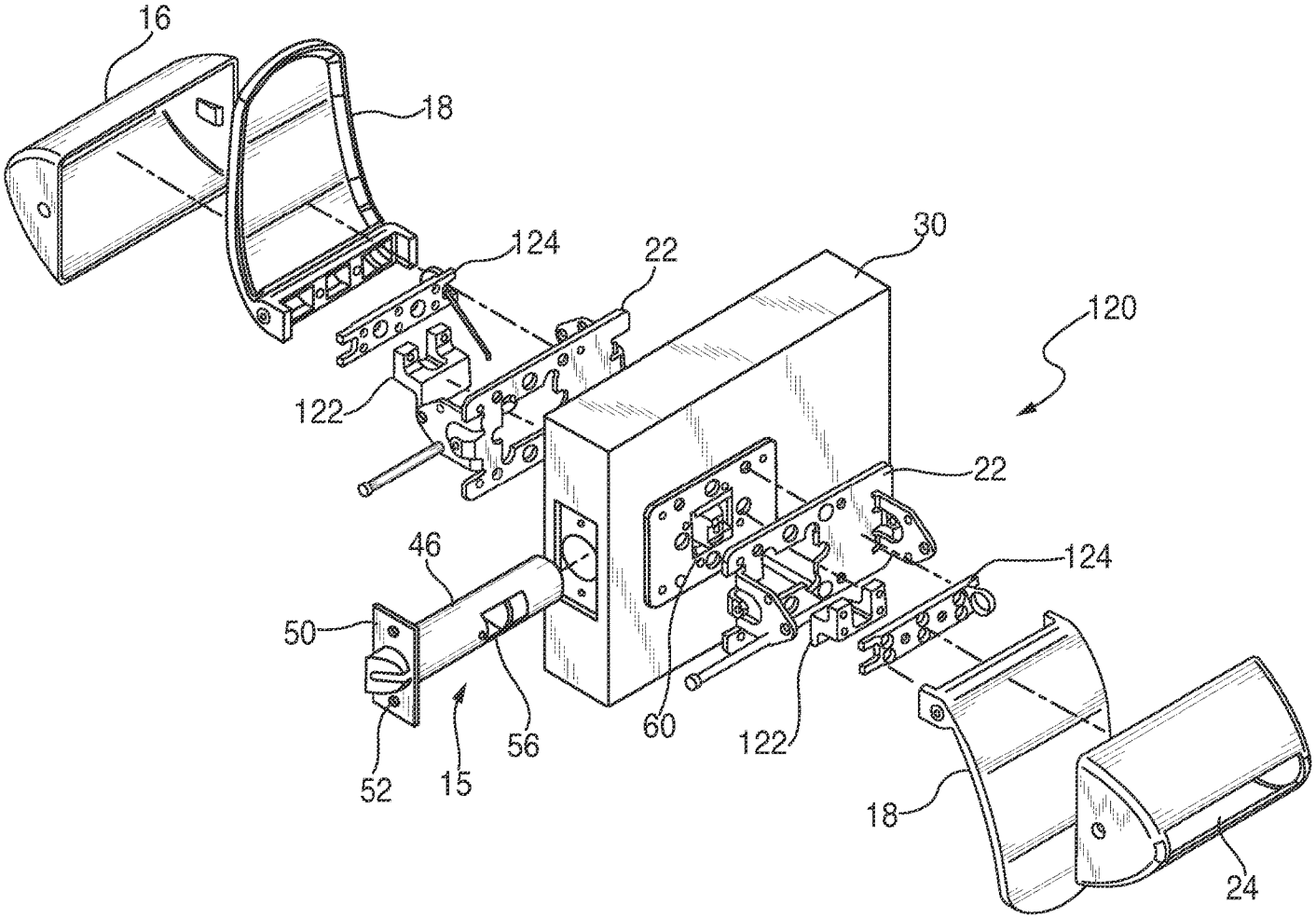
FIG. 13 is top exploded perspective view of a present door latch assembly shown mounted on a door.
Figure 14:
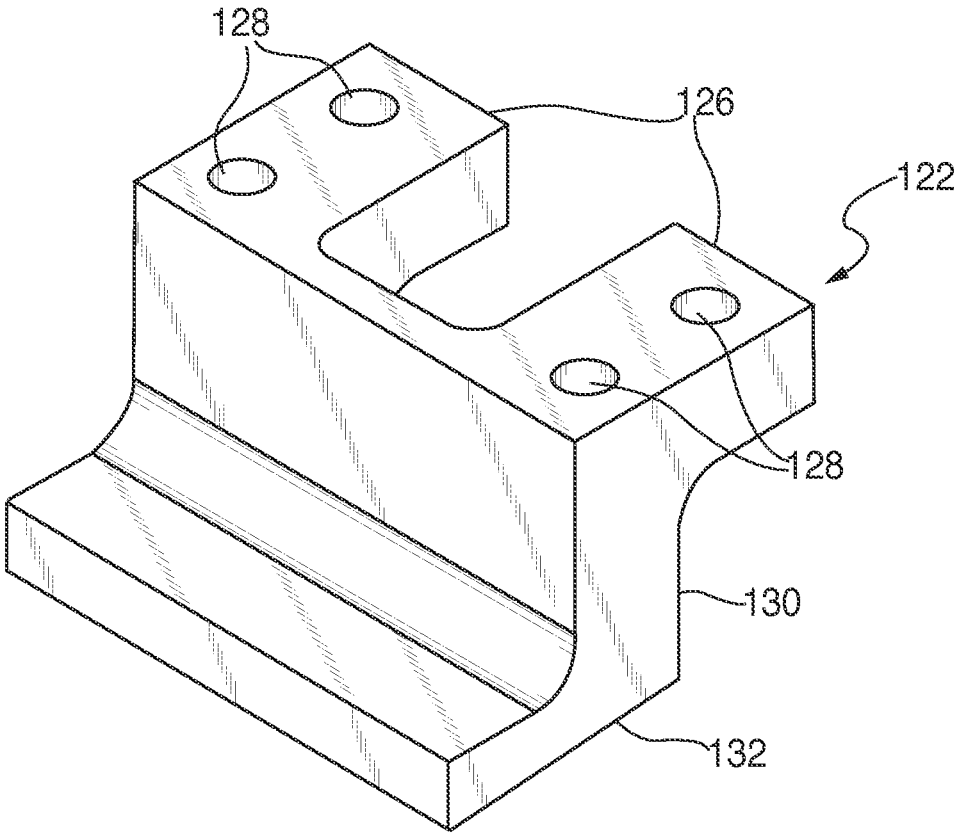
FIG. 14 is a side perspective view of an embodiment of a push/pull cam actuator (low profile backset) used in the present door latch assembly.

Referring now to FIG. 13, an alternate embodiment of the latch assembly 10 is generally designated 120. Components shared with the assembly 10 are designated with identical reference numbers. A main distinguishing feature of the assembly 120 is the cam actuator 122, which shares function with the actuators 67, 68, but includes distinctive structure. Further, the latch assembly 120 includes an adjustable adapter plate 124 that is coupled door handle 18 and provides a mounting point for the cam actuator 122. The functioning of latch assembly in general and the adjustable adapter plate 124 in particular can be found in US Pub. No. 20130076046 which is incorporated by reference. In one embodiment, it is contemplated that the cam actuator 122 is attachable at more than one place, either right, left or center, to the adjustable adapter plate 124. Referring to FIG. 14, the cam actuator 122 is particularly configured for use with the push/pull low profile door latch assemblies such as latch assembly 120 and is configured to be attached or coupled to the cam engaging portion 90 of the door handle 18. Further, the door handle cam actuator 122 is configured to engage the cam 60 thereby overcoming the default biased force of the spring of the sliding bolt mechanism of the door bolt assembly 15 from a latched position to a release position.

The cam actuator 122 includes block-shaped door handle engaging portions 126, a cam actuator surface 130, and a flat cam engaging surface 132 configured to engage the cam 60 and the cam body 66 having complimentary surfaces 69, 70 configured in certain angles, radii, and finishes. Further, the door handle engaging portions 126 are spaced apart from one another. In addition, while other configurations are contemplated, in the preferred embodiment the cam actuator surface 130 is substantially perpendicular to the door handle engaging portions 126 as well as being substantially perpendicular to the flat cam engaging surface 132. Thus, the cam actuator surface 132 is offset in space between the door handle engaging portions 126 and the flat cam engaging surface 132 such that the door handle engaging portions are in a different but parallel vertical plane with respect to the flat cam engaging surface 132.

Embodiments of the door latch assembly 120 include cam actuators 122 coupled to either a push or pull door handle 18 that engages a cam 60 having a cam block 75 attached to the cam body notch 74. Other embodiments include cam actuators 122 coupled to either a push or pull door handle 18 that engages a cam 60 without cam block 75 attached.

The cam actuator 122 is optionally paired with a push or pull door handle 18 and then oriented either horizontally (perpendicular to the length of the door) or vertically (parallel to the length of the door) depending on need. Further, the cam actuator 122 includes a plurality of cam actuator mounting holes 128 that are used to mount the cam actuator to the door handle 18.

Figure 15:
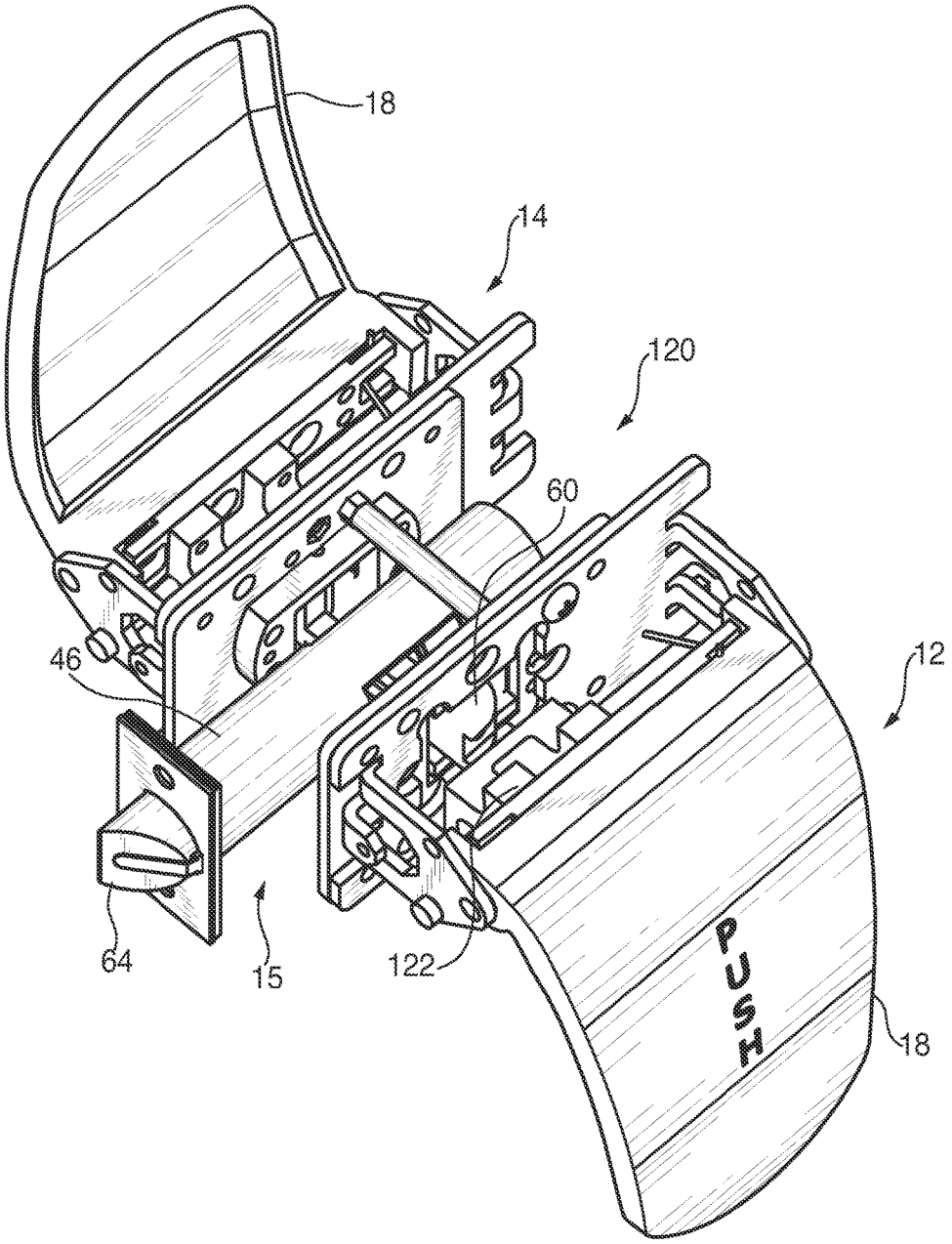
FIG. 15 is a top perspective view of an embodiment of the door latch assembly with the push door handle assembly in the latch position.

Referring to FIG. 15, the door latch assembly 120 is shown in the latch position. Further, in the latch position, the cam actuator 122 touches the cam 60 but is not engaging the cam to cause latch action. Also, the strike of door bolt assembly 15 is in an extended position. However, referring to FIG. 16, the door latch assembly is shown in release position, whereby a downward pushing force on the handle 18, represented by the arrow 'A' causes the cam actuator 122, and specifically the surface 132 to engage the cam 60, causing pivoting action of the cam in the cam holder 78 (FIG. 4), and corresponding lateral movement of the finger 58 due to pivoting action of the cam 60 about the pivot pin 85. Movement of the finger 58 causes the strike 64 to retract within the door (not shown).

Referring again to FIGS. 15-16, it will be seen that the present door latch assembly 120 includes the door bolt assembly 15 having the sliding bolt 46 configured for reciprocal sliding action between a latch position and a release position. Further, the door latch assembly 120 includes a door handle assembly 12, 14 configured for being fastened to the door in one of a plurality of orientations with respect to a length of the door 30.

Figure 16:
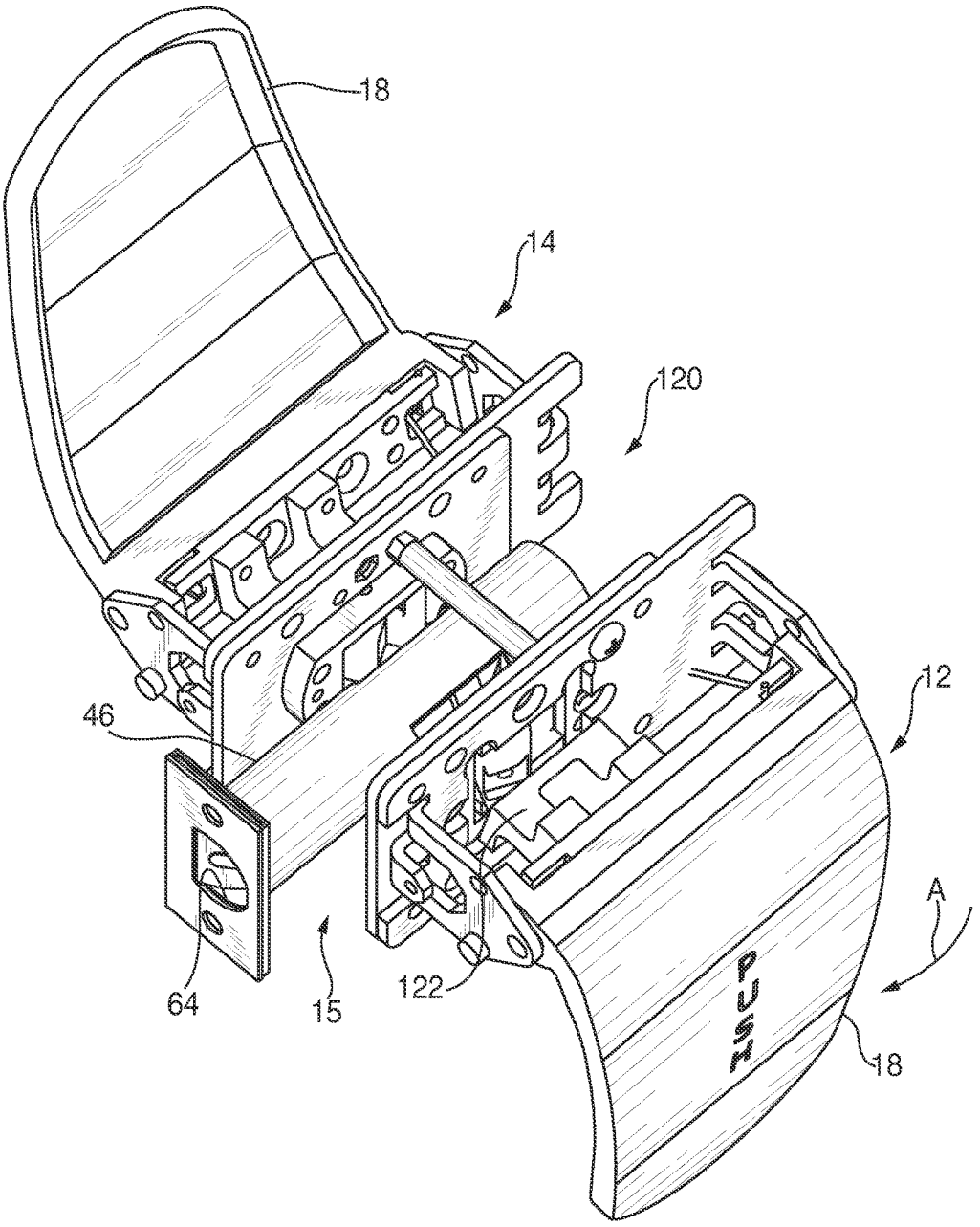
FIG. 16 is a top perspective view of the door latch assembly of FIG. 15 with the push door handle assembly in the release position.

In the embodiments shown in FIGS. 15-16, in the door latch assembly 120, the door handle assembly 12, 14 is positionable vertically or parallel with respect to the length of the door 30. That is, the longitudinal axis of the door handle 18 is parallel to the length of door 30. However, in other embodiments, the door latch assembly 120 is mounted to orient and position the door handle assembly 12, 14 horizontally or perpendicular to the length of the door 30. That is, the longitudinal axis of the door handle 18 is perpendicular to the length of door. The convertible cam drive allows flexibility for an installer of the door latch assembly 120 to orient or position the door handle assembly 12, 14 in different ways depending to the different circumstances and uses for the space using the door without the need for reconfiguring or boring a new hole in the door or installing a new door latch/bolt assembly.

While particular embodiments of the present door latch assembly with a convertible cam drive assembly has been described herein, it will be appreciated by those skilled in the art that changes and modifications may be made without departing from the invention in its broader aspects and as set forth in the following claims.

The invention claimed is:

1. A door latch assembly with a convertible cam drive having a door bolt assembly including a sliding bolt slidingly reciprocating between a latch position and a release position, said door latch assembly comprising:

a door handle assembly including;

a base plate having a pivot pin, a cam receiving aperture and a plurality of holes in operational relationship to said aperture and configured for being fastened to a door in one of a plurality of orientations, which includes at least one of a long edge of said plate being parallel to a length of the door and the long edge of said plate being perpendicular to the length of the door;

a door handle having a cam engaging portion, said door handle configured for pivoting relative to said base plate from a rest position to an actuating position; and a cam drive assembly including:

a pivoting cam having a finger;

a cam holder configured for placement within the cam receiving aperture of the base plate in an orientation in which a long edge of said cam holder is parallel to the sliding bolt; and said cam drive assembly being constructed and arranged for receiving the cam engaging portion of the door handle when pivoted from the rest position to the actuating position, thereby causing pivoting action of said cam, whereby said finger engages and moves the sliding bolt from a latch position to a release position.

2. The door latch assembly of claim 1, wherein the cam drive assembly further includes a cam actuator configured for attachment to the cam engaging portion of the door handle and engaging the cam.

3. The door latch assembly of claim 2, wherein the cam actuator is mountable upon the door handle in a selected one of two orientations.

4. The door latch assembly of claim 3, wherein the cam holder includes:

a cam pivot pin;

a plurality of cam pivot pin holes configured for receiving the cam pivot pin;

a cam receiving aperture;

said cam holder constructed and arranged for securing the cam within the cam receiving aperture by placement of the cam pivot pin through each of the plurality of cam pivot pin holes.

5. The door latch assembly of claim 2, wherein:

the door bolt assembly further includes:

a bolt opening and a rear surface;

said cam actuator being secured to the cam engaging portion of the door handle and configured for moving the finger laterally along the axis of the sliding bolt within the bolt opening and making contact with the rear surface of the sliding bolt thereby moving the sliding bolt from the latch position to the release position.

6. The door latch assembly of claim 2, wherein the cam actuator secured to the engaging portion of at least one of a push door handle and a pull door handle.

7. The door latch assembly of claim 1, wherein the door handle is at least one of a push door handle and a pull door handle.

8. The door latch assembly of claim 1, wherein the cam drive assembly further includes a cam block secured to the cam.

9. A door handle assembly for use with a door latch assembly with a cam assembly further having a cam actuator configured for attachment to the cam engaging portion of the door handle and engaging a cam such that cam actuator is mountable upon the door handle in a selected one of a plurality of orientations, said door handle assembly comprising:

a door bolt assembly including:

a sliding bolt configured for reciprocal sliding action between a latch position and a release position, wherein said sliding bolt has a bolt opening and a rear surface;

a door handle assembly including;

a pivot pin;

a door handle having a cam engaging portion, said door handle configured for pivoting relative to the pivot pin from a rest position to an actuating position; and a base plate coupled to the door handle, having a cam receiving aperture and a plurality of holes configured for being attached to a door in one of a plurality of orientations, which includes at least one of a long edge of said plate being parallel to the length of the door and the long edge of said plate being perpendicular to the length of the door;

the cam drive assembly including;

a cam having a finger;

a cam holder configured for placement within the cam receiving aperture of the base plate in an orientation in which a long edge of said cam holder is parallel to said sliding bolt;

said cam actuator secured to the cam engaging portion of the door handle and configured for moving said finger laterally along the axis of said sliding bolt within the bolt opening, and making contact with the rear surface of the sliding bolt, thereby moving the sliding bolt from the latch position to the release position.

10. The door latch assembly of claim 9, wherein the cam holder includes:

a cam pivot pin;

a plurality of cam pivot pin holes configured for receiving the cam pivot pin;

a cam receiving aperture;

said cam holder constructed and arranged for securing the cam within the cam receiving aperture by placement of the cam pivot pin through each of the plurality of cam pivot pin holes.

11. The door latch assembly of claim 9, wherein the door handle is at least one of a push door handle and a pull door handle.

12. The door latch assembly of claim 9, wherein the cam actuator secured to the engaging portion of at least one of a push door handle and a pull door handle.

* * * * *